US006055827A

United States Patent [19]

Tojo et al.

[11] Patent Number: 6,055,827

[45] Date of Patent: May 2, 2000

[54] REFRIGERANT COMPRESSOR AND REFRIGERATING APPARATUS

[75] Inventors: Kenji Tojo, Ibaraki-ken; Hideyuki Ueda, Shimizu; Yoshikatsu Tomita, Shizuoka; Takao Mizuno, Shimizu, all of Japan

[73] Assignee: Hitachi, Ltd, Tokyo, Japan

[21] Appl. No.: 09/373,598

[22] Filed: Aug. 13, 1999

Related U.S. Application Data

[62] Division of application No. 09/151,274, Sep. 11, 1998.

[30] Foreign Application Priority Data

Sep. 11, 1997 [JP] Japan ..... 9-246480

[51] Int. Cl.[7] ..... F25B 43/02

[52] U.S. Cl. ..... 62/468

[58] Field of Search ..... 252/67, 68; 62/467, 62/468, 469

[56] References Cited

U.S. PATENT DOCUMENTS

| | | | |
|---|---|---|---|
| 5,480,572 | 1/1996 | Minor | 252/67 |
| 5,639,719 | 6/1997 | Tanaka et al. | 508/580 |
| 5,653,909 | 8/1997 | Muraki et al. | 252/68 |

*Primary Examiner*—Henry Bennett
*Assistant Examiner*—Malik N. Drake
*Attorney, Agent, or Firm*—Antonelli, Terry, Stout & Kraus, LLP

[57] ABSTRACT

The refrigerating apparatus of the invention has a scroll compressor having a compressing section sucking and compressing a hydrofluorocarbon-based refrigerant, a condenser and the like, in which a plain bearing slidably supporting a driving shaft driving the compressing section of the scroll compressor is made of a material containing lead, and an ether oil miscible with the refrigerant used in a refrigerant circuit is used as a lubricant for lubricating the plain bearing.

2 Claims, 4 Drawing Sheets

REFRIGERANT COMPRESSOR AND REFRIGERATING APPARATUS

This is a divisional application of U.S. Ser. No. 09/151,274, filed Sep. 11, 1998.

BACKGROUND OF THE INVENTION

1. Field of the Invention

The present invention relates to a refrigerant compressor and a refrigerating apparatus. More particularly, the invention relates to a refrigerant compressor and a refrigerating apparatus using at least a refrigerant selected from the group of hydrofluorocarbon-based refrigerants or a mixed refrigerant formed by mixing two or more refrigerants selected from the group, i.e., an HFC-based refrigerant in place of the conventional CFC-based or HCFC-based refrigerants containing chlorine.

2. Description of the Related Art

In a conventional refrigerant compressor composing a refrigerating apparatus, a plain bearing made of a material comprising a surface layer containing lead bronze, a resin such as PTFE and a lead component for improving slidability is usually used in a sliding section engaging with a driving shaft of the compressor or an engaging section with a stationary member rotatably supporting the driving shaft.

On the other hand, R-12, a CFC-based refrigerant containing chlorine, and R-22, an HCFC-based refrigerant, have been used as a refrigerant. As compared with sulfur dioxide and methylchloride, refrigerants used therebefore, these conventional refrigerants are chemically more stable, less toxic and non-flammable. They had therefore been popularly employed as ideal refrigerants. More recently, however, chloride contained in the CFC-based and HCFC-based refrigerants were found to destruct the ozone layer of the stratosphere, and there is an urgent demand for the development and use of a new refrigerant taking the place of these conventional refrigerants. Highly practicable new refrigerants taking the place of the CFC-based and HCFC-based refrigerants include hydrofluorocarbon (HFC)-based refrigerants not containing chloride.

Because a refrigerating lubricant is discharged from a compressor, carried by the flow of the refrigerant in the refrigerating apparatus, and circulated in the compressor, the oil should have misciblity with the refrigerant. Mineral oils and alkylbenzene oil used as conventional CFC-based or HCFC-based refrigerants have a very low misciblity with the above-mentioned HFC-based alternative refrigerants. It is therefore conceived to use an ester oil miscible with the alternative refrigerants.

However, when an HFC-based refrigerant, an alternative refrigerant, and an ester oil, a refrigerating lubricant, are combined and used, and the compressor is based on a combination of a plain bearing comprising a material containing lead, lead contained in the material of the bearing precipitates in the refrigerating lubricant, thus resulting in deterioration of the refrigerating lubricant. Deterioration of the refrigerating lubricant leads to a poorer lubricity of the sliding portions such as the bearing section, this further causing wear and galling of the sliding portions and hence a decrease in reliability.

Also in the case where the compressor has a rolling bearing, the rolling bearing receives a very high load on a limited small load bearing surface. The lubricant fed to the load bearing surface of the rolling bearing therefore locally receives a very high pressure. An ester oil has a far smaller viscosity under a high pressure than a mineral oil and a low oil film forming ability on the load bearing surface. The ester oil was thus found to suffer from wear and galling of the sliding portions, leading to a lower reliability.

SUMMARY OF THE INVENTION

The present invention has an object to provide a refrigerant compressor and a refrigerating apparatus, excellent in reliability, which, even when using a combination of a compressor having a plain bearing made of a material containing lead and a hydrofluorocarbon-based refrigerant not containing chlorine as a refrigerant, can inhibit precipitation of lead from the plain bearing section into a refrigerating lubricant.

Another object of the invention is to provide a refrigerant compressor and a refrigerating apparatus, excellent in reliability, which, even when using a combination of a compressor having a rolling bearing and a hydrofluorocarbon-based refrigerant not containing lead as a refrigerant, is capable of keeping a high viscosity of a refrigerating lubricant on the load bearing surface of the rolling bearing.

The first feature of the present invention for achieving the aforementioned object is a refrigerant compressor comprising a compressing section sucking and compressing a refrigerant selected from the group of hydrofluorocarbon-based refrigerants or a mixed refrigerant formed by mixing two or more refrigerants selected from the above group of refrigerants, and a plain bearing slidably supporting a driving shaft for driving the compressing section; wherein the plain bearing comprises a member containing lead, and an ether oil miscible with the sucked and compressed refrigerant is used as a lubricating oil for the plain bearing.

The second feature of the invention is a refrigerant compressor comprising a compressing section sucking and compressing a refrigerant selected from the group of hydrofluorocarbon-based refrigerants or a mixed refrigerant formed by mixing two or more refrigerants selected from the above group of refrigerants, and a plain bearing slidably supporting a driving shaft for driving the compressing section; wherein the compressing section sucking and compressing the refrigerant comprises a scroll type compressor mechanism composed of a pair of spiral scrolling members; a sliding engagement section engaging the scrolling members of the scroll type compressor mechanism and the driving shaft thereof comprises a member containing lead; and ether oil is used as a lubricant for lubricating the sliding engagement section.

The third feature of the invention is a refrigerant compressor comprising a compressing section sucking and compressing a refrigerant selected from the group of hydrofluorocarbon-based refrigerants or a mixed refrigerant formed by mixing two or more refrigerants selected from the above group of refrigerants, and a plain bearing slidably supporting a driving shaft for driving the compressing section on a stationary member; wherein the compressing section sucking and compressing the refrigerant comprises a scroll type compressor mechanism composed of a pair of spiral scrolling member; a sliding engagement section engaging the scrolling members of the scroll type compressor mechanism and the plain bearing slidably supporting the driving shaft comprises a member containing lead; and ether oil is used as a lubricant for lubricating the sliding engagement section and the plain bearing.

The fourth feature of the invention is a refrigerant compressor comprising a compressor mechanism sucking and compressing a refrigerant selected from the group of hydrofluorocarbon-based refrigerants or a mixed refrigerant formed by mixing two or more refrigerants selected from the above group of refrigerants, a driving shaft for driving the compressor mechanism, and a plain bearing which supports a force generated upon compressing the refrigerant at the compressor mechanism by the rotation of the driving shaft and has a sliding section containing lead; wherein an ether oil miscible with the refrigerant is used as a lubricant.

The fifth feature of the invention is a refrigerating apparatus comprising a compressor sucking and compressing a refrigerant selected from the group of hydrofluorocarbon-based refrigerants or a mixed refrigerant formed by mixing two or more refrigerants selected from the above group of refrigerants, and a condenser; wherein the compressor has a driving shaft for driving the compressing section, and a plain bearing slidably supporting the driving shaft, and the plain bearing comprises a member containing lead; and wherein an ether oil miscible with the refrigerant used for a refrigerant circuit is used as a lubricant for lubricating the plain bearing.

The sixth feature of the invention is a refrigerating apparatus comprising a refrigerant circuit composed of a scroll compressor using a plain bearing for slidably supporting a driving shaft for driving a compressing section, a condenser, a expansion device, and an evaporator connected to each other; wherein a refrigerant sealed in the refrigerant circuit is selected from the group of hydrofluorocarbon-based refrigerants or a mixed refrigerant formed by mixing two or more refrigerants selected from the above group of refrigerants; the plain bearing of the scroll compressor comprises a member containing lead; and an ether oil is used as a lubricant for lubricating the plain bearing.

The seventh feature of the invention is a refrigerating apparatus comprising a refrigerant circuit formed by piping-connecting a scroll compressor having a scroll type compressor mechanism composed of a pair of spiral scrolling members, a condenser, a expansion device and an evaporator; wherein a refrigerant selected from the group of hydrofluorocarbon-based refrigerants or a mixed refrigerant formed by mixing two or more refrigerants selected from the above group of refrigerants is sealed in the refrigerant circuit; wherein the scroll compressor has a sliding engagement section engaging the scrolling member of the compressor mechanism and a driving shaft thereof, and a plain bearing for slidably supporting the driving shaft on a stationary member, the sliding engagement section and the plain bearing comprising members containing lead; and wherein an ether oil miscible with the refrigerant used in the refrigerant circuit is used as a lubricant for lubricating the sliding engagement section and the plain bearing.

The eighth feature of the invention is a refrigerant compressor comprising a compressing section sucking and compressing a refrigerant selected from the group of hydrofluorocarbon-based refrigerants or a mixed refrigerant formed by mixing two or more refrigerants selected from the above group of refrigerants, and a bearing slidably supporting a driving shaft for driving the compressing section; wherein the bearing comprises a rolling bearing, and an ether oil miscible with the refrigerant to be sucked and compressed is used as a lubricant for lubricating the rolling bearing.

The ninth feature of the invention is a refrigerant compressor comprising a compressing section sucking and compressing a refrigerant selected from the group of hydrofluorocarbon-based refrigerants or a mixed refrigerant formed by mixing two or more refrigerants selected from the above group of refrigerants, and a bearing slidably supporting a driving shaft for driving the compressing section on a stationary member; wherein the compressing section sucking and compressing the refrigerant comprises a scroll type compressor mechanism composed of a pair of spiral scrolling members; the bearing slidably supporting the driving shaft for driving the scroll type compressor mechanism comprises a rolling bearing, and an ether oil is used as a lubricant for lubricating the rolling bearing.

The tenth feature of the invention is a refrigerant compressor comprising a compressor mechanism sucking and compressing a refrigerant selected from the group of hydrofluorocarbon-based refrigerants or a mixed refrigerant formed by mixing two or more refrigerants selected from the above group of refrigerants, a driving shaft for driving the compressor mechanism and a rolling bearing supporting the driving shaft, wherein an ether oil miscible with the refrigerant is used as a lubricant.

The eleventh feature of the invention is a refrigerating apparatus comprising a compressor sucking and compressing a refrigerant selected from the group of hydrofluorocarbon-based refrigerants or a mixed refrigerant formed by mixing two or more refrigerants selected from the above group of refrigerants, and a condenser; wherein the compressor has a driving shaft for driving the compressor section, and a bearing slidably supporting the driving shaft; the bearing comprises a rolling bearing; and an ether oil miscible with the refrigerant used for a refrigerant circuit is used as a lubricant for lubricating the rolling bearing.

The twelfth feature of the invention is a refrigerating apparatus comprising a refrigerant circuit composed of a scroll compressor using a bearing for slidably supporting a driving shaft for driving a compressing section, a condenser, a expansion device, and an evaporator connected to each other; wherein a refrigerant sealed in the refrigerant circuit is selected from the group of hydrofluorocarbon-based refrigerants or a mixed refrigerant formed by mixing two or more refrigerants selected from the above group of refrigerants; the bearing of the scroll compressor comprises a rolling bearing; and an ether oil is used as a lubricant for lubricating the rolling bearing.

The thirteenth feature of the invention is a refrigerating apparatus comprising a refrigerant circuit formed by piping-connecting a scroll compressor having a scroll type compressor mechanism composed of a pair of spiral scrolling members, a condenser, a expansion device and an evaporator; wherein a refrigerant selected from the group of hydrofluorocarbon-based refrigerants or a mixed refrigerant formed by mixing two or more refrigerants selected from the above group of refrigerants is sealed in the refrigerant circuit; the scroll compressor has a sliding engagement section engaging the scrolling member of the compressor mechanism and a driving shaft thereof, and a bearing for slidably supporting the driving shaft on a stationary member, the bearing comprising a rolling bearing; and an ether oil miscible with the refrigerant used in the refrigerant circuit is used as a lubricant for lubricating the rolling bearing.

The suitable main component of the aforementioned ether oil having miscibility with the refrigerant, i.e., miscible with the refrigerant is a polyvinylether-based compound or a cyclic ether-based compound, and particularly, an ether oil mainly comprising a polyvinylether-based compound.

An embodiment of the above-mentioned plain bearing is one having a steel backing provided with an intermediate layer containing porous bronze and a surface layer containing a resin such as PTFE and a lead component. An embodiment of the aforementioned rolling bearing is a radial type rolling bearing.

In the configuration as described above, when the compressor mechanism is operated by the rotation of the driving shaft, the compressor repeats a refrigerating cycle of sucking and compressing the refrigerant. The refrigerant, being at least one selected from the group of hydrofluorocarbon-based refrigerants or a mixed refrigerant formed by mixing two or more thereof, does not cause a problem such as destruction of the ozone layer.

The ether oil miscible with the hydrofluorocarbon-based refrigerant used as a refrigerating lubricant is discharged from the compressor into the refrigerating apparatus, dissolved in the refrigerant, flows, together with the refrigerant, through the refrigerant circuit composing the refrigerating apparatus, circulated to the compressor, and serves to lubricate the sliding portions of the compressor.

The ether oil serving as a refrigerating lubricant is miscible with the aforementioned hydrofluorocarbon-based refrigerant, and the ratio of precipitation of lead contained in the plain bearing member of the refrigerant compressor is far smaller than that of the conventional ester oil. Under conditions including a high temperature for a long period of time, therefore, this oil is hardly deteriorated and is stable in quality. As a result, the sliding portions such as the bearing do not suffer from wear or galling, thus providing a refrigerant compressor and a refrigerating apparatus excellent in reliability.

The ether oil, which is a refrigerating lubricant, has a high viscosity even under a high pressure as compared with an ester oil, and is therefore capable of maintaining its oil film forming ability even under a high local pressure acting on the load bearing surface of the rolling bearing. As a result, the sliding portions such as the bearing never suffer from wear or galling, thus giving a refrigerant compressor or a refrigerating apparatus excellent in reliability.

Other features, objects and advantages of the present invention will become apparent from the following description with reference to the attached drawings.

DESCRIPTION OF THE PREFERRED EMBODIMENTS

It is known that, in a refrigerant compressor or a refrigerating apparatus, the combination of the aforementioned alternative refrigerant, an ester oil serving as a refrigerating lubricant, and a refrigerant compressor having a plain bearing containing lead causes deterioration of the refrigerating lubricant, and wear and galling of the sliding portions, thus making it impossible to obtain a sufficient reliability.

More specifically, in the combination of an HFC-based refrigerant, an alternative refrigerant, and an ester oil serving as a refrigerating lubricant, if the interior of the compressor is kept at a high temperature, lead contained in the material for the bearing section precipitates into the refrigerating lubricant and causes deterioration of the refrigerating lubricant. Deterioration of the refrigerating lubricant in turn causes a decrease in lubricity of the sliding portions, thus causing wear or galling of the sliding portions. The ester oil has a high hygroscopicity. The absorbed water decomposes the ester oil to generate an acid. Reaction of this acid with lead in the material for the bearing is considered to be a cause of precipitation of lead in the refrigerating lubricant.

Embodiments of the present invention for solving these problems and obtaining a refrigerant compressor or a refrigerating apparatus excellent in reliability will now be described with reference to the drawings.

Figure 1:
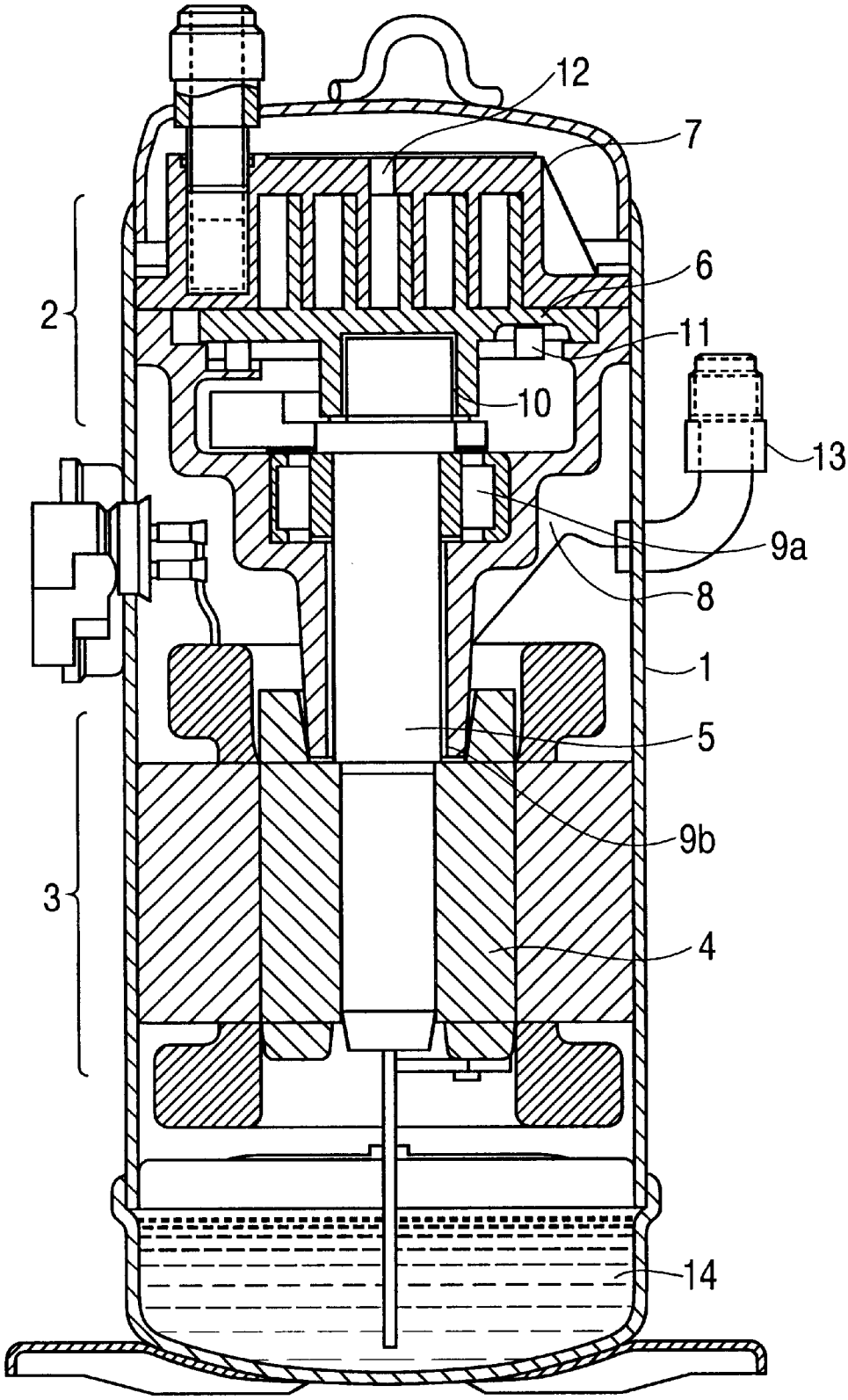
FIG. 1 is a longitudinal sectional view illustrating an embodiment of the refrigerant compressor of the present invention.

FIG. 1 illustrates an overall configuration of a hermetic type scroll compressor (refrigerant compressor) showing an embodiment of the present invention. In a hermetic chamber 1, a compressor mechanism 2 is housed in an upper portion, and a motor 3 for driving the compressor mechanism is housed in a lower portion. A driving shaft 5 of the compressor mechanism is connected to a rotor 4 of the motor 3, and the driving shaft 5 is rotatably supported by main bearing members 9*a* and 9*b* provided on a frame member 8. The main bearing member 9*a* is a radial type rolling bearing excellent in slidability, and the main bearing member 9*b* as well comprises a plain bering made of a material containing lead excellent in slidability.

The compressor mechanism 2 is provided with a pair of spiral scrolling members 6 and 7, i.e., a fixed scroll 7 and a orbiting scroll 6 each having a spiral wrap. The orbiting scroll 6 engages on the back (surface opposite to the wrap side) thereof with the aforementioned driving shaft 5 via a orbiting bearing member 10. A rotation inhibiting member 11 is arranged on the back of the orbiting scroll. The orbiting bearing member 10 is made of a material containing lead.

The orbiting scroll 6 orbits by the rotation of the driving shaft 5 while rotation is prevented. As a result, a compression gas pocket formed by the both scroll members 6 and 7 gradually move from periphery toward the center. The volume is thus gradually reduced and the gas is compressed. The gas is discharged from a discharge port 12 provided at the center of the fixed scroll 7 onto the upper portion in the hermetic chamber 1. The discharged refrigerant gas passes through a discharge pipe 13 provided in the hermetic chamber 1 between the compressor mechanism 2 and the motor 3 and sent out the compressor.

Upon operation of the compressor mechanism 2 by the rotation of the driving shaft 5, the aforementioned compressor provided in the refrigerant circuit repeats the cycle of sucking and compressing the refrigerant gas, thus operating the refrigerating cycle.

The refrigerant used in-the above-mentioned refrigerant circuit is a refrigerant selected from the group of hydrofluorocarbon-based refrigerants or a mixed refrigerant formed by mixing two or more refrigerants selected from the above group of refrigerants, and this refrigerant, not containing chlorine, causes no problem such as destruction of the ozone layer. Examples of such a refrigerant include single refrigerants such as HFC134a, HFC32, HFC125, and HFC143a, and mixed refrigerants formed by mixing two or more selected from the group of hydrofluorocarbon-based refrigerants such as HFC407c, HFC407E, HEC410A, HFC404A, and HFC507A.

In FIG. 1, 14 is a refrigerating apparatus oil (lubricant oil) accumulated in the lower portion of the hermetic chamber 1, which is an ether oil miscible with the aforementioned hydrofluorocarbon-based refrigerant. An oil feeding channel (not shown) is provided at the center of the driving shaft. The refrigerating lubricant is sent through this oil feeding channel to the main shafts 9*a* and 9*b* and the orbiting bearing 10 to lubricate the bearing. A part of the refrigerating lubricant serves also to lubricate the sliding portions of the rotation preventing member 11 and the scrolling members 6 and 7. The refrigerating lubricant having served as the lubricant is discharged, together with the refrigerant gas, from the discharge port 12 into the upper portion in the hermetic chamber 1, then appropriately separated from the refrigerant gas in the hermetic chamber, and stored on the bottom of the hermetic chamber.

A suitable refrigerating lubricant is an ether oil mainly comprising a polyvinylether-based compound or a cyclic ether-based compound. More particularly, among various other oils having ether linkage applicable as a refrigerating lubricant, a side-chain ether oil or a cyclic ether oil is suitable as an ether oil in the invention, and a polyvinylether compound comprising a single polymer or a copolymer of alkylvinylether is particularly suitable as a side-chain ether oil.

The refrigerating lubricant used for the refrigerating apparatus is generally used in a refrigerant atmosphere in the refrigerant circuit. The refrigerant compressor provided in the refrigerant circuit is generally a hermetic type compressor housing a motor section 3 and a compressor mechanism 2 in the hermetic chamber 1. The refrigerating lubricant is stored in the lower portion thereof and serves to lubricate the sliding portions of the compressor. A part of the refrigerating lubricant is circulated, together with the refrigerant, in the refrigerant circuit. A refrigerating lubricant is therefore required to be miscible with refrigerant, excellent in lubricity, electric insulating property, chemical stability, safety and misciblity with metal and organic materials.

An ester oil has therefore conventionally been used as a refrigerating lubricant miscible with a hydrofluorocarbon-based refrigerant. When the ester oil is kept at a high temperature in a refrigerant atmosphere, however, lead partially used in the bearing material is precipitated in the oil, thus causing deterioration of the oil, as described above.

Figure 4:
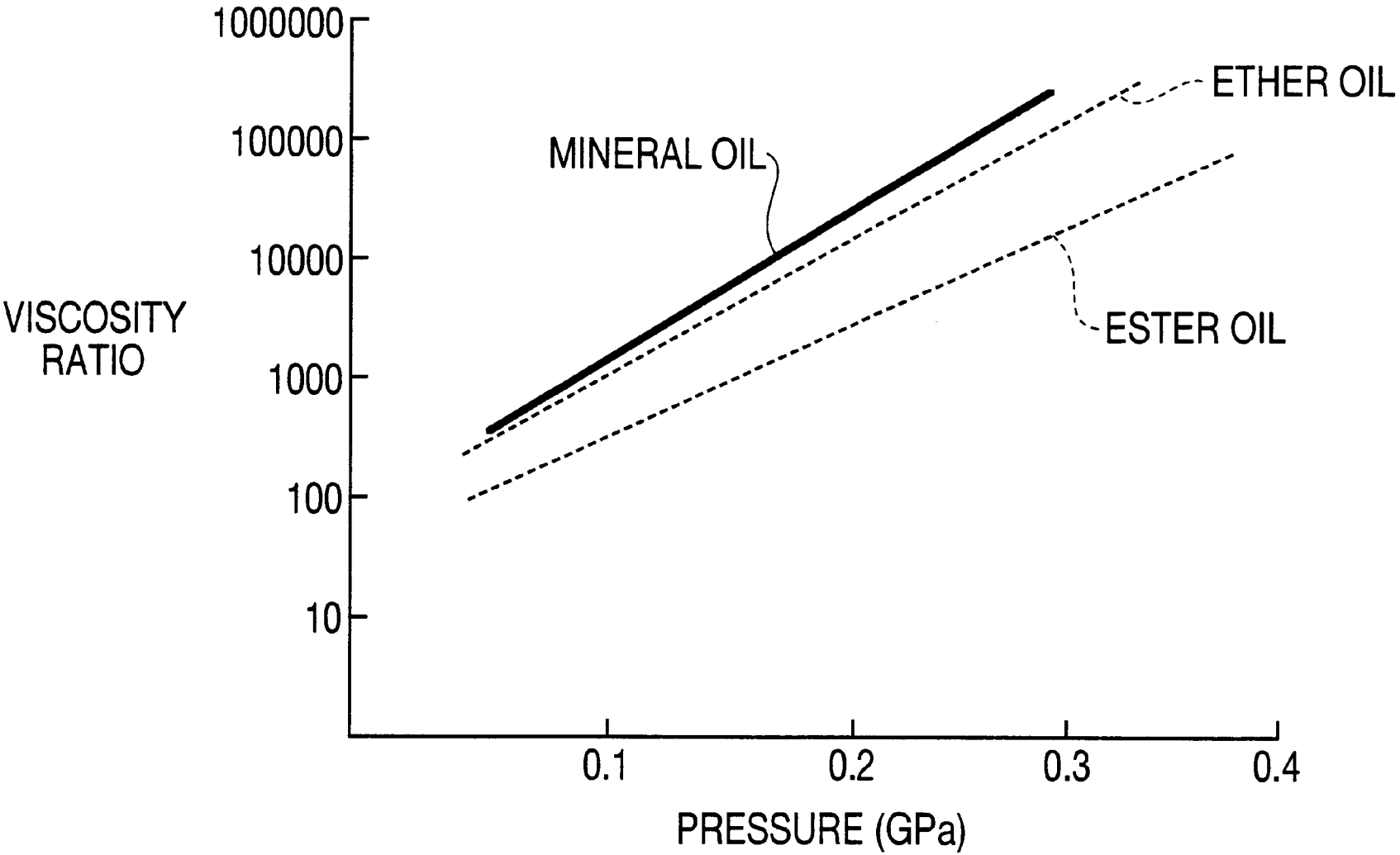
FIG. 4 is a graph illustrating pressure and viscosity properties of lubricant oils used in the conventional refrigerant compressor and in that of the invention.

When operating under a high load in a refrigerant atmosphere, as described above, the ester oil has a problem of causing a damage to the rolling bearing. The rolling bearing receives a very high load on a limited load bearing surface. As a result, a lubricant oil fed to the load bearing surface of the rolling bearing is subject to a high pressure, so that viscosity of the lubricant oil under such a high pressure largely affects oil film formation on the load bearing surface. That is, a higher viscosity under a high pressure is more favorable for oil film formation on the rolling bearing, leading to a higher reliability of the rolling bearing. FIG. 4 illustrates the relationship between pressure and viscosity for different kinds of lubricant oil. While an ether-based lubricant oil exhibits a pressure-viscosity property close to that of the conventional mineral oil, an ester-based lubricant oil has a viscosity under a high pressure smaller than that of a mineral oil or an ether oil. As a result, when carrying out compressing operation under a high load, the oil film formability of the rolling bearing becomes insufficient, resulting in a damage. Table 1 shows the results of a reliability test carried out on compressors under a high load.

TABLE 1

| Compressor | Lubricant | Result | Remarks |
|---|---|---|---|
| A | Ester oil | ○ | No problem |
| B | Ester oil | X | Roll bearing flaking |
| C | Ester oil | X | " |
| A' | Ether oil | ○ | No problem |
| B' | Ether oil | ○ | " |
| C' | Ether oil | ○ | " |

Test conditions: Discharge pressure; at 3 Mpa or more
Discharge gas temperature; at 100° C. or more
Compressor A, A': nominal capacity - 2.2 kw
Compressor B, B': nominal capacity - 3.75 kw
Compressor C, C': nominal capacity - 3.75 kw According to these results, while use of an ester-based lubricant oil resulted in damage to two out of three rolling bearings, use of an ether-based lubricant oil caused no damage to any of the three rolling bearings, thus suggesting that the ether-based lubricant oil is excellent in lubricity under a high load.

When configuring a refrigerating apparatus by the use of a compressor provided with a rolling bearing, use of a hydrofluorocarbon-based refrigerant and an ester oil as a refrigerating lubricant leads to a high possibility of a damage to the rolling bearing and occurrence of wear or galling. When using an ether oil as a refrigerating lubricant as in the present embodiment, an excellent oil film formability can prevent damage to the rolling bearing. As a result, it is now possible, by the use of an ether oil, to use a rolling bearing excellent in slidability at the sliding portions supporting a force generated from rotation of the driving shaft upon compressing the refrigerant in the sliding portions of the compressor such as the compressor mechanism.

When a high temperature is kept in a refrigerant atmosphere, as described above, the ester oil causes precipitation of lead used partially in the bearing material, leading to deterioration of the oil.

A sealed tube test was carried out by immersing lead alone or a bearing material containing lead into a refrigerating lubricant in a hydrofluorocarbon-based refrigerant atmosphere, and determining the quantity of lead precipitation into the oil after maintaining a high temperature for a certain period of time, and the extent of acid generated by oil deterioration, as expressed in total acid value (determined by neutralizing the generated acid with KOH; a larger value corresponds to a higher acidity). The results of this misciblity test of a hydrofluorocarbon-based refrigerant and a refrigerating lubricant with lead alone and bearing materials containing lead are shown in Table 2.

TABLE 2

| | | Lead alone | Bearing material A | Bearing material B | Bearing material C |
|---|---|---|---|---|---|
| Ester oil | Lead precipitation (ppm) | 67 | 20 | 45 | 15 |
| | Total acid value (mgkOH/g) | 0.062 | 0.767 | 0.513 | 1.379 |
| Ether oil | Lead precipitation (ppm) | 1.4 | 1.5 | 2.5 | 0.6 |
| | Total acid value (mgkOH/g) | 0.003 | 0.003 | 0.023 | 0.003 |

Test conditions: 175° C., 20 days, refrigerant: R407C, refrigerant/oil: 1 ml/2 ml TABLE 2-continued

| | Lead alone | Bearing material A | Bearing material B | Bearing material C |
|---|---|---|---|---|

Bearing material:
A; porous bronze impregnated with lead and PTFE
B; porous lead bronze impregnated with PTFE
C; carbon impregnated with lead According to these results, for the ester oil, lead was precipitated into the oil, with a high total acid value, in all combinations with lead alone and lead-containing bearing materials, thus permitting observation of oil deterioration. In the case of the ether oil, in contrast, even in combinations with lead alone and the lead-containing bearing materials, the quantity of lead precipitation into the oil is very slight, with a small total acid value, so that no deterioration of oil was observed, revealing an excellent stability.

Therefore, as described above, when a refrigerating apparatus comprises a compressor provided with a bearing made of a lead-containing material, used of a hydrofluorocarbon-based refrigerant and an ester oil as a refrigerating lubricant was revealed to cause precipitation of lead from the bearing material into the refrigerating lubricant, resulting a refrigerating lubricant deterioration and a considerable risk of causing wear or galling of the sliding portions of the compressor. When using an ether oil as a refrigerating lubricant as in the present embodiment, precipitation of lead from the bearing material is very slight, thus permitting inhibition of oil deterioration. As a result, it is now possible to use a plain bering made of a material containing lead excellent in slidability for the sliding portions of the compressor such as the sliding portion supporting the force generated by rotation of the driving shaft upon compression of the refrigerant in the compressor mechanism, by using an ether oil. Suitable bearing materials containing -lead include a copper-lead alloy and lead-bronze. The plain bearing should preferably comprises an intermediate layer containing porous bronze in the steel backing'thereof and a surface layer containing a resin such as PTFE and a lead component. Particularly, precipitation of lead can be minimized while improving slidability by adopting a ratio of at least 30% of the resin material such as PTFE on the surface of the plain bearing.

Figure 2:
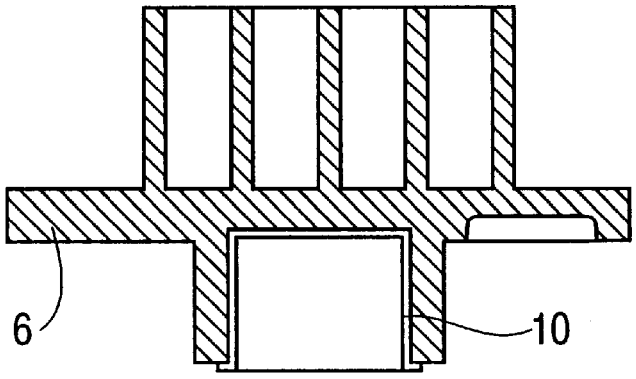
FIG. 2 is a longitudinal sectional view of a rotary scroll used in the compressor shown in FIG. 1 and a plain bearing portion used therein.

FIG. 2 illustrates a orbiting bearing 10 engaging with the driving shaft 5 on the back of the orbiting scroll 6 This orbiting bearing 10 also comprises a plain bearing made of a material containing lead. The position to be provided with a plain bearing comprising a lead-containing material is not limited to the orbiting bearing 10.

Figure 3:
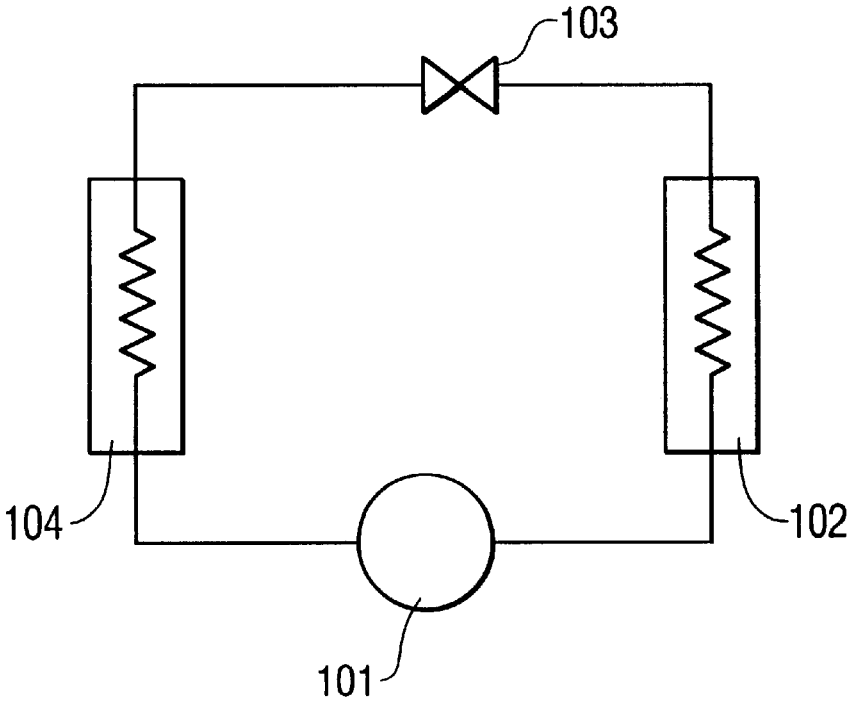
FIG. 3 is a refrigerant circuit diagram illustrating an embodiment of the refrigerating apparatus having a refrigerant compressor to which the invention is applied.

FIG. 3 illustrates a refrigerating apparatus comprising a refrigerant compressor 101 provided with a rolling bearing and a bearing made of a material containing lead, a condenser 102, a expansion device (composed of an electronic expansion valve, a capillary tube and the like) 103, and an evaporator 104, using a hydrofluorocarbon-cased refrigerant not containing chlorine as a refrigerant, and using an ether oil excellent in misciblity with the refrigerant. By adopting this configuration, it is possible to improve reliability, with a high oil film formability on the load bearing surface of the rolling bearing, without causing wear or galling of the sliding portions. The quantity of lead precipitated from the plain bearing member into the refrigerating lubricant is very slight and deterioration of the refrigerating lubricant is inhibited. Because the refrigerant and the refrigerating lubricant are miscible with each other, oil is not accumulated in the refrigerating circuit, but flows, together with the refrigerant through the refrigerating circuit and circulated to the refrigerant compressor, thus leading to a higher reliability.

In the invention, at least one refrigerant selected from the group of hydrofluorocarbon-based refrigerants or a mixed refrigerant of two or more thereof is used. The refrigerant does not therefore contain chlorine, and causes no problem such as destruction of a ozone layer.

An ether oil is employed as a refrigerating lubricant for the refrigerant compressor provided in the refrigerant circuit composing the refrigerating apparatus. The refrigerating lubricant, which is miscible with the hydrofluorocarbon-based refrigerant, is miscible with the refrigerant even after discharge from the compressor into the refrigerant circuit, circulated to the compressor after flowing, together with the refrigerant, through the refrigerant circuit, and is fed to the sliding portions to serve to lubricate again the sliding portions of the compressor. At this point, the ether oil has a high viscosity, as compared with an ester oil, under a high pressure, and can maintain a sufficient oil film formability even under a high local pressure on the load bearing surface of the rolling bearing. The ether oil, showing a very low ratio of precipitation of lead contained in the plain bearing material of the refrigerant compressor as compared with the ester oil, hardly suffers from deterioration even at high temperature for a long period of time, and is therefore stable. As a result, wear or galling never occurs in the sliding portions such as the bearing of the refrigerant compressor, and there are provided a refrigerant compressor and a refrigerating apparatus excellent in reliability.

Figure 5:
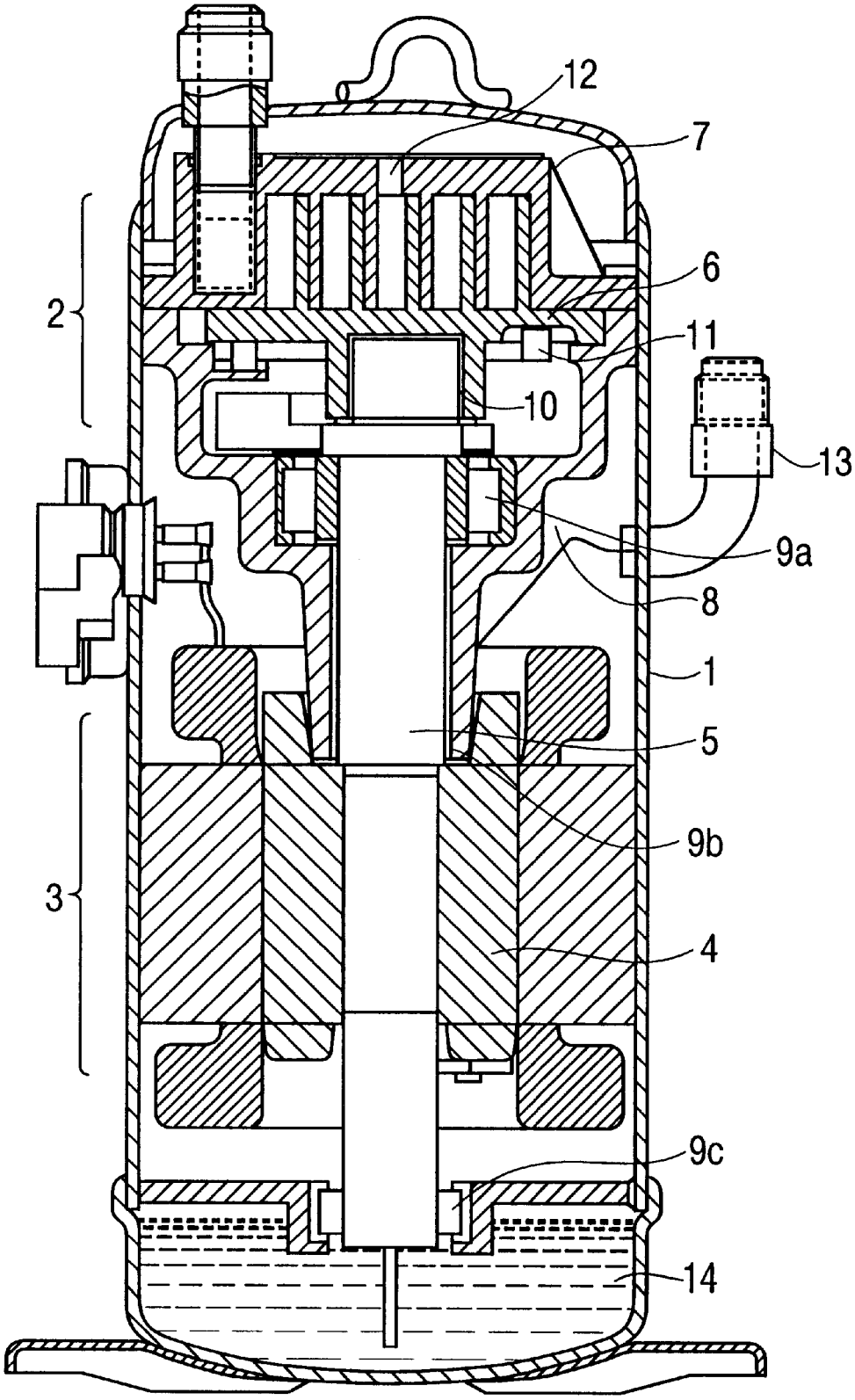
FIG. 5 is a longitudinal sectional view illustrating a variation of the refrigerant compressor of the invention.

FIG. 5 illustrates a configuration in which the driving shaft driving the compressor mechanism is rotatably supported by a plurality of rolling bearings 9*a* and 9*c*. The position of the rolling bearings is not limited to this.

According to the present invention, the plain bearing is made of a material containing lead and an ether oil miscible with the refrigerant to be sucked and compressed is used as a lubricant for the plain bearing. Even when using a plain bearing made of a material containing lead excellent in slidability in combination with a hydrofluorocarbon-based refrigerant not containing chlorine as a refrigerant, therefore, it is possible to inhibit precipitation of lead from the plain bearing into the refrigerating lubricant, and hence to provide a refrigerant compressor and a refrigerating apparatus excellent in reliability.

Since a hydrofluorocarbon-based refrigerant not containing chlorine is used, there occurs no problem such as destruction of the ozone layer. Further, because an ether oil is used as a refrigerating lubricant, miscible with the hydrofluorocarbon-based refrigerant, the oil flows through the refrigerant circuit together with the refrigerant, and stably circulated to the compressor to serve to lubricate the sliding portions.

Even when using a compressor having a rolling bearing in combination with a hydrofluorocarbon-based refrigerant not containing chlorine, furthermore, use of a ether oil miscible with the refrigerant to be sucked and compressed as a lubricant for the rolling bearing ensures a sufficient oil film formability even under a high local pressure acting on the load bearing surface of the rolling bearing, thus enabling to provide a refrigerant compressor and a refrigerating apparatus excellent in reliability.

We claim:

1. A refrigerant compressor comprising a compressing section sucking and compressing a refrigerant comprising at least one member selected from the group consisting of hydrofluorocarbon-based refrigerants, and a plain bearing slidably supporting a driving shaft for driving said compressing section; wherein said plain bearing comprises a member containing lead, and an ether oil miscible with said sucked and compressed refrigerant is used as a lubricating oil for said plain bearing, wherein said ether oil having misciblity with the refrigerant mainly comprises a cyclic ether-based compound.

2. A refrigerant compressor comprising a compressing section sucking and compressing a refrigerant comprising at least one member selected from the group consisting of hydrlfluorocarbon-based refrigerants, and a bearing slidably supporting a driving shaft for driving said compressing section; wherein said bearing comprises a rolling bearing, and an ether oil miscible with said refrigerant to be sucked and compressed is used as a lubricant for lubricating said rolling bearing, wherein said ether oil miscible with the refrigerant mainly comprises a cyclic ether-based compound.

* * * * *